US005420769A

United States Patent [19]

Ahlgren et al.

[11] Patent Number: 5,420,769

[45] Date of Patent: May 30, 1995

[54] HIGH TEMPERATURE LAMP ASSEMBLY WITH IMPROVED THERMAL MANAGEMENT PROPERTIES

[75] Inventors: Frederic F. Ahlgren, Euclid; Gary R. Allen, Chesterland; William J. Cassarly, Richmond Heights; Willie J. Cheney, East Cleveland; John M. Davenport, Lyndhurst; Richard L. Hansler, Pepper Pike; John W. Munk, Jr., Chesterland, all of Ohio

[73] Assignee: General Electric Company, Schenectady, N.Y.

[21] Appl. No.: 153,000

[22] Filed: Nov. 12, 1993

[51] Int. Cl.[6] ..... F21V 29/00

[52] U.S. Cl. ..... 362/294; 362/373; 362/345; 165/80.3

[58] Field of Search ..... 362/264, 373, 294, 457, 362/345; 165/80.2, 80.3

[56] References Cited

U.S. PATENT DOCUMENTS

| | | | |
|---|---|---|---|
| 3,936,686 | 2/1976 | Moore | 362/294 |
| 4,419,716 | 12/1983 | Koo | 362/373 |
| 4,734,835 | 3/1988 | Vines et al. | 362/264 |
| 4,872,097 | 10/1989 | Miller | 362/373 |
| 5,111,367 | 5/1992 | Churchill | 362/264 |
| 5,205,642 | 4/1993 | Kai et al. | 362/264 |
| 5,329,436 | 7/1994 | Chiu | 362/373 |

*Primary Examiner*—Ira S. Lazarus
*Assistant Examiner*—L. Heyman
*Attorney, Agent, or Firm*—George E. Hawranko; Stanley C. Corwin

[57] ABSTRACT

A lamp assembly includes improved thermal management properties provided by a thermal shield received about the neck region of a reflector. This reduces the temperature in the seal region of the light source. Additionally, the thermal shield can be incorporated into a modular housing to provide a contained lamp assembly. The module includes cooling fins that effectively reduce the temperature of the module without adversely effecting the light output. Alternatively, the housing is operatively connected to an external, secondary heat sink.

15 Claims, 2 Drawing Sheets

Fig. 4
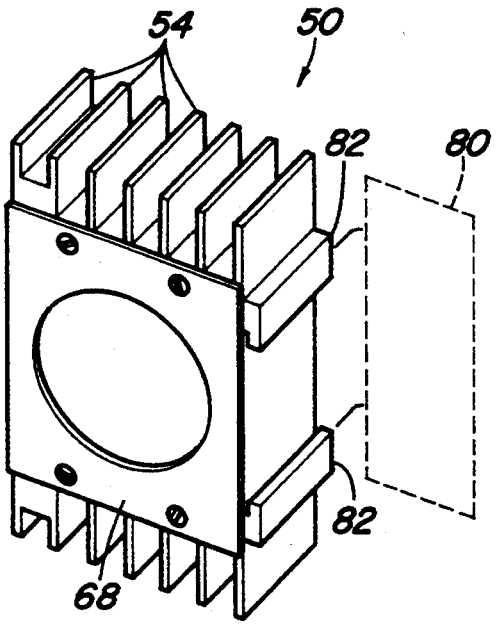
Fig. 5
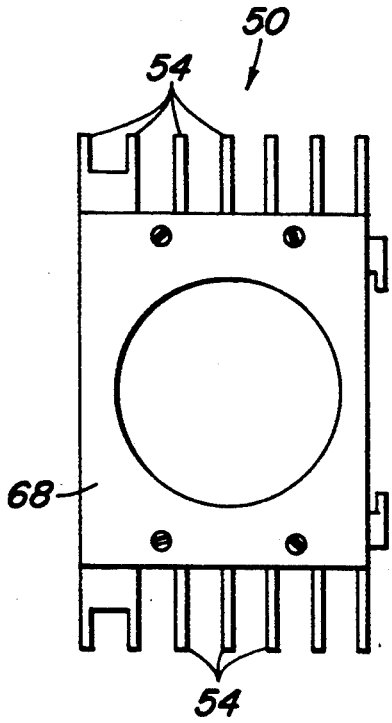
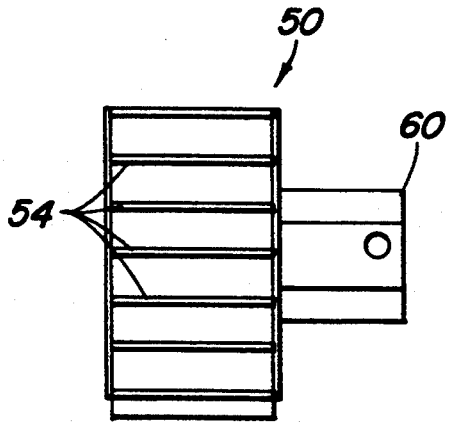
Fig. 6

HIGH TEMPERATURE LAMP ASSEMBLY WITH IMPROVED THERMAL MANAGEMENT PROPERTIES

BACKGROUND OF THE INVENTION

This invention pertains to the art of high temperature lamp assemblies and more particularly to thermal control of the lamp assembly to control the life of the lamp and adapt the lamp to a wider array of end uses.

The invention is particularly applicable to a high brightness light source enclosed in a module or housing and will be described with particular reference thereto. However, it will be appreciated that certain aspects have broader applications and may be advantageously employed in related lamp environments and applications.

High brightness light sources have come under increasing use, particularly in central lighting systems where light is conveyed to a remote location via a light distribution apparatus. The high brightness lighting system is also useful in other environments but one drawback to these types of systems is the associated high temperature. One preferred high brightness light source is an arc discharge source as defined in commonly assigned U.S. Pat. No. 5,239,230 to Mathews, et al. The light source described in that patent provides an effective brightness in excess of 50,000 lumens per centimeter squared and is also intended for extended useful life on the order of 2,000 hours of operation or longer. This particular light source operates at a high temperature, for example, the arc tube operates at 800° to 900° C. Other light sources than the arc discharge arrangement described in the '230 patent are considered high brightness sources. For example, U.S. Pat. No. 5,045,748, issued Sep. 3, 1991 to Ahlgren, et al. is another example of a high brightness light source that operates at an elevated temperature.

Typically, a thin metal foil such as a molybdenum foil is used at a seal interface between an envelope and the electrical supply to electrodes having inner ends disposed in the arc chamber. Exposure of the metal foil to elevated temperatures for prolonged periods of time has been known to result in oxidation and expansion of the metal foil. The seal then opens and vents the envelope so that effective operation of the lamp is terminated. The temperature versus oxidation rate has a threshold value near 350° C. In other words, prolonged exposure of the seal at or above the threshold temperature can result in rapid oxidation. On the other hand, maintaining the seal at a temperature below this threshold value decreases the rate of oxidation and thereby results in longer lamp life.

Continued development of the high brightness light source and its incorporation into a module has required increased emphasis on thermal management. Controlling the overall temperature of the immediate housing also has a desirable impact on lamp life. Preferably, the housing should also address related concerns such as containment of the lamp assembly, alignment and replaceability, as well as ultraviolet and infrared protection.

In the past, attempts to control the elevated operating temperature and its effect on the surrounding environment focused on using fans as a primary source for cooling. Although for some uses this may still be the preferred method for cooling a lamp assembly, blowing air on the high brightness arc tube can adversely effect the light output. The operating parameters of the light source are particularly temperature sensitive so that the light color may be altered by using a cooling fan, and in more extreme situations, start up of the lamp may be effected.

SUMMARY OF THE INVENTION

The present invention contemplates a new and improved thermal management for a high temperature lamp assembly that overcomes all of the above-referenced problems and others and provides a compact, modular lamp assembly that can be adapted to a wide array of uses.

According to the present invention, the high temperature lamp assembly includes a high brightness light source associated with a reflector for directing light in a desired manner. A housing that contains the light source and reflector includes means for controlling the thermal environment of the lamp assembly.

According to one aspect of the invention, the housing is provided with external cooling fins along a peripheral portion to improve radiative and convective cooling.

According to another aspect of the invention, a thermal shield is used to protect an envelope seal of the light source.

A principal advantage of the invention is the increased lamp life provided by thermal control of the lamp assembly.

Yet another advantage of the invention resides in the compact, modular unit that effectively addresses thermal concerns while providing other related benefits.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which will be described in detail in this specification and illustrated in the accompanying drawings which form a part hereof, and wherein:

FIG. 4 is a perspective view of the assembled module of FIG. 3;

FIG. 5 is a front elevational view of the assembled module of FIG. 4; and FIG. 6 is a top plan view of the assembled module of FIG. 4.

DETAILED DESCRIPTION OF THE PREFERRED EMBODIMENTS

Figure 1:
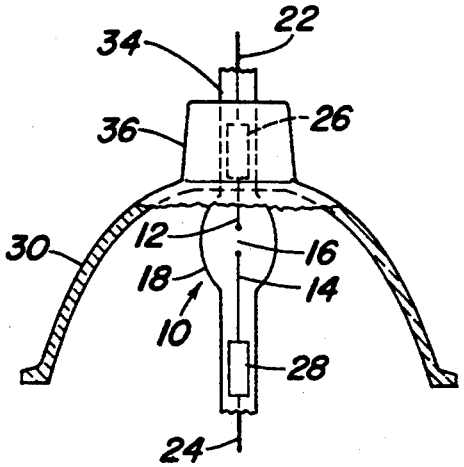
Fig. 1 (PRIOR ART)
FIG. 1 is an elevational view, partly in section, of a prior art lamp assembly.

Referring now to the drawings wherein the showings are for the purposes of illustrating the preferred embodiments of the invention only and not for purposes of limiting same, the FIGURES show a high brightness lamp assembly having improved thermal management properties that extend lamp life. More particularly, and with reference to FIG. 1, one preferred high brightness lamp assembly includes an arc discharge light source 10 having first and second electrodes 12, 14 with inner ends received in a chamber 16 of an envelope 18. The envelope is preferably formed from a vitreous material such as a fused quartz and the chamber contains a pressurized fill that enhances the light discharge when current is supplied to the electrodes. A pair of outer leads 22, 24 are electrically connected to the electrodes through thin metal foils 26, 28. Typically, the metal foil is a molybdenum construction that forms a seal with the envelope, although it will be understood that still other electrically conductive materials could be used.

The gap defined between the electrodes is advantageously positioned relative to reflector 30 so that light emitted from the source is directed in a controlled manner. In the preferred arrangement, a first end 34 of the double ended envelope extends through a neck region 36 of the reflector. In this manner, electrical connection with a source wire (not shown) and the outer lead 22 will be completed at a region disposed outside of the reflector. This general type of high brightness lamp assembly is, as mentioned above, described in greater detail in commonly assigned U.S. Pat. No. 5,239,230 to Mathews, et al. Other high brightness light sources than the arc discharge arrangement such as taught in U.S. Pat. No. 5,045,748 can be used with equal success. High brightness lamps of this type operate at elevated temperatures in the range of 800° to 900° C. Thus, even though regions adjacent the arc gap are at a temperature substantially less than this operating temperature, the high temperature is a concern since the heat must be dissipated.

Figure 2:
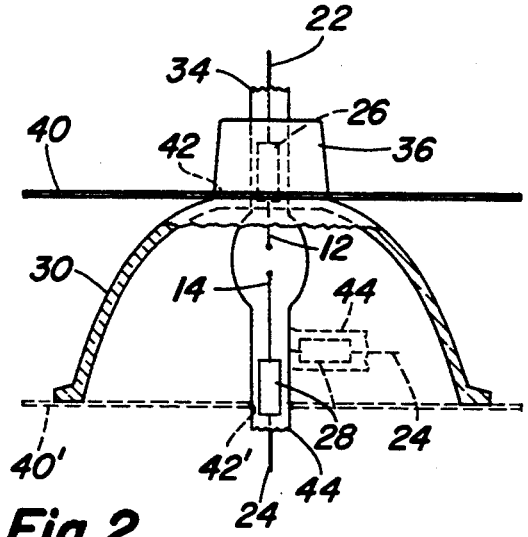
FIG. 2 is a view similar to FIG. 1 and illustrating use of an improved thermal management arrangement in accordance with the subject invention.
Figure 3:
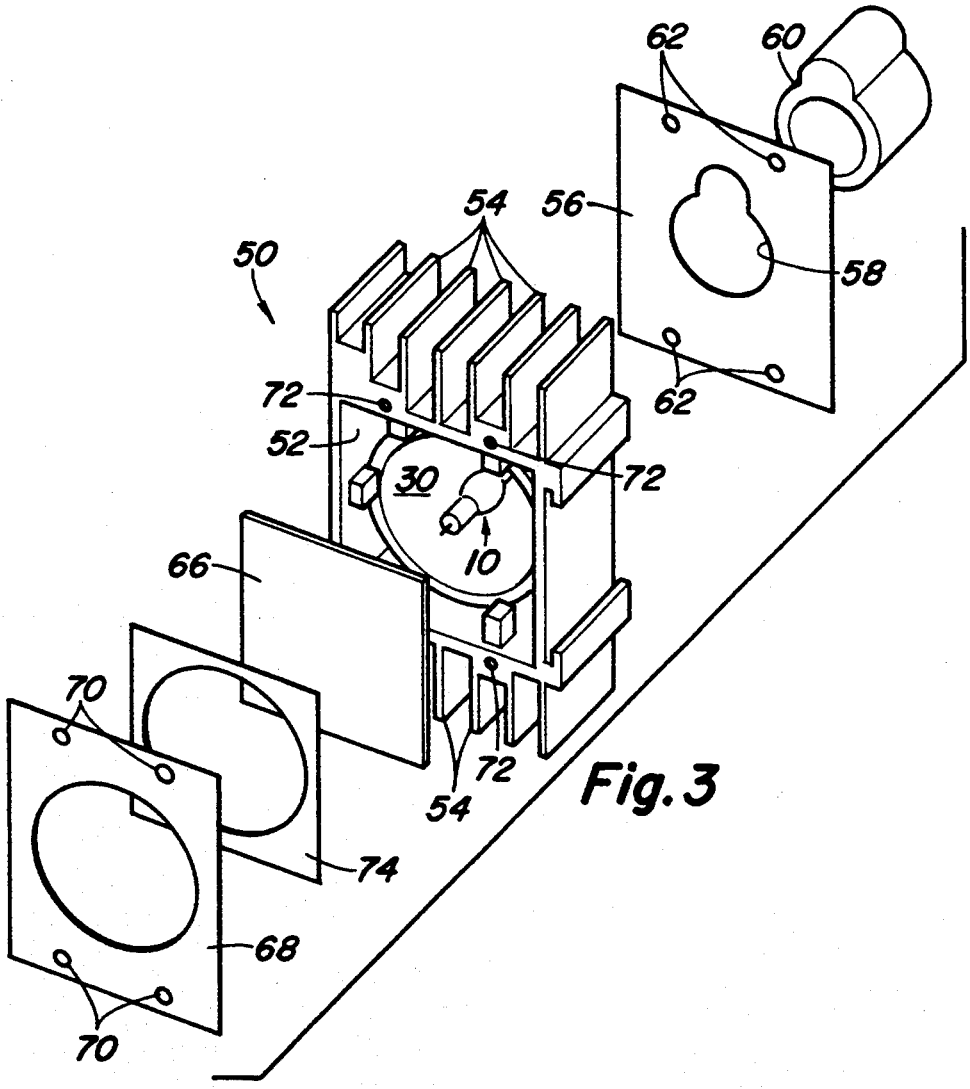
FIG. 3 is an exploded perspective view of the module of FIG. 3.

Turning now to FIG. 2, a high brightness lamp assembly incorporating improved thermal management properties is shown therein. The structure and operation of the lamp assembly as described in FIG. 1 is generally applicable to this arrangement. Additionally, a thermal shield 40 has a central opening 42 that allows the shield to be easily positioned over the neck region 36 of the reflector. The shield, in some respects, is counter-intuitive since it would appear that the absence of a shield and open arrangement would allow heat to radiate away from the lamp assembly. In fact, though, increased cooling of the critical seal region results with use of the shield 40. Reduced temperature leads to reduced probability of oxidation and extended lamp life.

In the preferred arrangement, the shield is formed from aluminum. It is believed, however, that a thermally conductive material is not necessary. For example, a glass or high temperature plastic may be used to reduce the temperature around the cathode seal and extend the life of the lamp. Incorporation of this type of thermal shield resulted in an approximately 30° C. reduction in temperature at the outer seal. The thermal shield need not be in physical contact with the reflector. Rather, it appears that the convective cooling of the reflector neck region, and therefore the cathode seal temperature, is improved with the addition of the shield.

As also shown in FIG. 2, a thermal shield 40' shown in phantom could be used to provide temperature control for the seal at the opposite end of the illustrated double ended lamp. The opening 42' in thermal shield 40' is dimensioned to closely receive the end 44 of the light source therethrough. The same cooling effect provided by thermal shield 40 and previously described with respect to the reflector neck region and seal of metal foil 26 applies to the thermal shield 40' and the seal of metal foil 28.

In other arrangements, the length of the metal foil 28 can be extended to address thermal concerns associated with the seal at the end of the double ended light source. The extended metal foil may be useful in arrangements where thermal shield 40' is not compatible or desired for use with the remainder of the lamp assembly. Likewise, the thermal shield 40' or extended length of metal foil 28 would not be necessary if a single ended lamp is used where both metal foils are located in the neck region of the reflector.

Dimensions of the arrangement may also indicate whether an extended metal foil 28 can be used as shown in solid line in FIG. 2. Allowing the end of the double ended light source to extend outwardly from the assembly may not be desired where compactness or other dimensional concerns are at issue. Therefore, the end 44 of the light source may adopt a bent configuration as shown in phantom in FIG. 2. Details of lamps using this end bend control can be found in commonly assigned, pending U.S. application Ser. No. 08/130,822, filed Oct. 4, 1993 (LD 10,559) of Feldman, et al.

The elevated temperature of the high brightness light source is also effectively controlled in the lamp assembly embodiment illustrated in FIGS. 3–6. The lamp assembly as shown in FIG. 2 is essentially included into a housing or module 50. Preferably, the module is of unitary construction, and in a preferred arrangement is a thermally conductive material such as a machined piece of extruded aluminum. Of course, other alternative materials could be used. The module has a through opening 52 that defines an interior cavity closely receiving the FIG. 2 lamp assembly. That is, the module opening is dimensioned to closely receive the outer diameter of the reflector, and likewise the depth of the module is configured to closely match the depth of the reflector. This provides for a relatively compact structure that still adequately addresses thermal management problems.

Disposed along the external periphery of the module are a set of cooling fins 54. The fins extend in generally parallel relation to one another and substantially perpendicular to the side wall of the module from which they extend. The cooling fins provide an increased surface area to the module that promotes conveyance of heat away from the lamp assembly. Of course, still other cooling fin arrangements could be used with equal success or as may be desired for a particular end use.

Opposite ends of the through opening 52 are closed by cover members to provide a contained unit that allows lamp components to be easily replaced or removed from the module. A first or rear cover member 56 has an opening 58 and is comparable to the thermal shield 40 described above. The opening 58 is received around the neck region of the reflector to reduce the temperature at the cathode molybdenum seal that is received in base 60. Additional fastener openings 62 are provided in the cover 56 which are easily and accurately aligned with, for example, threaded openings formed in the module.

The second cover is a two component arrangement defined by a cover glass 66 and associated frame 68. It is to be understood that the term cover glass is to be more broadly construed as a transparent material that provides impact protection. Additionally, the cover glass may be provided with an ultraviolet or infrared filter or the like to control selected properties of the electromagnetic spectrum emitted by the light. The frame 68 includes suitable fastener openings 70 that cooperate with like openings 72 in the module to accurately locate and hold the cover glass in place over the front end of opening 52. If desired, a flat spring 74 may be associated with the cover glass to allow limited movement thereof during thermal cycling. As is known, if a cover glass is tightly constrained during thermal cycling, the expansion and contraction may lead to cracking of the glass.

The assembled arrangement shown in FIG. 4 provides a module in which selected components may be easily replaced and yet still provide ease of access to the lamp assembly. The cooling fins can substantially reduce the temperature on the outside of the module relative to the operating temperature of the light source. Moreover, a reduced temperature of 100° C. or less on the exterior of the module is attained without the use of fans or air directly contacting the light source which, as described above, could adversely effect its light output.

Of course, it will be recognized that the described arrangement could achieve still further cooling with the light source enclosed in the module if a fan is directed toward the cooling fins. This would enhance the temperature reduction without directly effecting operation of the light source. The module provides a controlled thermal environment that is related to extended lamp life. Thus, the overall reduction in the temperature provided by this arrangement advantageously leads to longer lamp life.

The cooling fins and thermal shield described above are one form of means for controlling the thermal environment of the lamp assembly. As shown in phantom in FIG. 4, an external, secondary heat sink 80 can be coupled to the lamp assembly to provide thermal management control. Coupling means 82 can be defined by fasteners, attaching arms or any thermally conductive structure to connect the lamp assembly to the heat sink 80 and obtain temperature reduction. Moreover, as evidenced by cover 56 (FIG. 3) that serves the same purpose of thermal management control as the thermal shield shown in FIG. 2, these various temperature controlling means can be used singly or in combination as may be required.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

What we claim as new and desire to secure by Letters Patent of the United States is:

1. A high temperature lamp assembly with improved thermal management properties comprising:
   - a high brightness light source for emitting light;
   - a reflector disposed relative to the light source to receive emitted light therefrom and direct the light in a desired manner;
   - a housing closely received about the light source and reflector, the housing having means for controlling the thermal environment of the lamp assembly; and
   - wherein said thermal controlling means includes external cooling fins as a primary heat sink and further includes means for coupling the housing to an external heat sink as a secondary heat sink.

2. The lamp assembly as defined in claim 1 wherein the housing includes a unitary member that provides continuous, peripheral containment along at least four sides of the lamp assembly.

3. The lamp assembly as defined in claim 2 wherein the housing is formed of a thermally conductive material that substantially encompasses non-active portions of the reflector.

4. The lamp assembly as defined in claim 3 wherein the housing is formed from aluminum.

5. The lamp assembly as defined in claim 1 wherein the housing has a through opening having a maximum width closely approximating a width of the reflector, opposite ends of the through opening being closed by a substantially transparent cover and a thermal shield, respectively.

6. The lamp assembly as defined in claim 5 wherein the thermal shield has an aperture dimensioned to receive a base of the lamp assembly therethrough, the base being connected to the light source and reflector.

7. The lamp assembly as defined in claim 6 wherein the light source is an arc discharge source having a metal foil interconnecting an outer lead to a an electrode, the metal foil forming a seal with a vitreous envelope of the light source, and the thermal shield being located adjacent a neck region of the reflector to decrease the temperature of the metal foil seal.

8. The lamp assembly as defined in claim 1 wherein the external cooling fins are disposed along a peripheral portion thereof to improve radiative and convective cooling.

9. A high temperature lamp assembly with improved thermal management properties comprising:
   - a high temperature light source having an envelope that encloses a light emitting element, the light emitting element forming a seal with the envelope adjacent one end thereof;
   - a reflector disposed adjacent the light source to receive light therefrom and direct the light in a desired manner, the reflector having a neck region that receives the one end of the envelope;
   - a thermal shield received over the neck region of the reflector for substantially cooling the one end of the envelope; and,
   - a housing closely received around the light source and reflector, the housing including means for controlling the thermal environment of the lamp assembly, the thermal controlling means including external cooling fins as a primary heat sink and further including means for coupling the housing to an external heat sink as a secondary heat sink.

10. The high temperature lamp assembly as defined in claim 9 further comprising a base that receives the neck region of the reflector and the one end of the envelope, the thermal shield having an opening closely dimensioned for through receipt of the base.

11. The high temperature lamp assembly as defined in claim 9 wherein the reflector has a central axis, the light emitting element being located on the central axis and the thermal shield being disposed generally perpendicular to the central axis.

12. The high temperature lamp assembly as defined in claim 9 wherein the housing has an opening therethrough that is substantially aligned with a central axis of the reflector, and further comprising a substantially transparent cover over a first end of the opening.

13. The high temperature lamp assembly as defined in claim 9 wherein the thermal shield is secured to the housing at a second end of the opening.

14. The high temperature lamp assembly as defined in claim 9 wherein the housing is a unitary member formed from a thermally conductive material.

15. The high temperature lamp assembly as defined in claim 9 wherein the housing is formed from aluminum.

* * * * *